US008057331B2

(12) United States Patent
Hudkins

(10) Patent No.: US 8,057,331 B2
(45) Date of Patent: Nov. 15, 2011

(54) CUTTING WHEELS ARCHERY BROADHEAD

(76) Inventor: Jason M. Hudkins, Rochester, IN (US)

( * ) Notice: Subject to any disclaimer, the term of this patent is extended or adjusted under 35 U.S.C. 154(b) by 248 days.

(21) Appl. No.: 12/561,020

(22) Filed: Sep. 16, 2009

(65) Prior Publication Data

US 2011/0065535 A1 Mar. 17, 2011

(51) Int. Cl.
*F42B 6/08* (2006.01)

(52) U.S. Cl. ..... 473/583

(58) Field of Classification Search ..... 473/578, 473/582, 583, 584

See application file for complete search history.

(56) References Cited

U.S. PATENT DOCUMENTS

| | | | |
|---|---|---|---|
| 2,568,417 | A | 9/1951 | Steinbacher |
| 3,578,328 | A | 5/1971 | Rickey |
| 3,618,948 | A | 11/1971 | McGlocklin |
| 5,078,407 | A | 1/1992 | Carlston et al. |
| RE34,397 | E | 10/1993 | DelMonte et al. |
| 5,286,035 | A | 2/1994 | Ward |
| 5,564,713 | A | 10/1996 | Mizek et al. |
| 5,857,930 | A | 1/1999 | Troncoso |
| 5,911,640 | A | 6/1999 | Breitwieser et al. |
| 5,941,784 | A | 8/1999 | Mizek |
| 6,165,086 | A | 12/2000 | Liechty, II |
| 6,174,252 | B1 | 1/2001 | Mizek |
| 6,200,237 | B1 | 3/2001 | Barrie |
| 6,306,053 | B1 | 10/2001 | Liechty, II |
| 6,319,161 | B1 | 11/2001 | Martinez et al. |
| 6,398,676 | B1 | 6/2002 | Mizek |
| 6,428,434 | B1 | 8/2002 | Liechty, II |
| 6,743,128 | B2 | 6/2004 | Liechty, II |
| 6,793,596 | B1 | 9/2004 | Sullivan et al. |
| 6,863,630 | B1 | 3/2005 | Watkins et al. |
| 6,966,856 | B1 | 11/2005 | Hajek |
| 7,311,622 | B1 | 12/2007 | Futtere |
| 7,422,533 | B1 | 9/2008 | Johnson |

*Primary Examiner* — John Ricci

(74) *Attorney, Agent, or Firm* — Gerald E. Helget; Briggs and Morgan, P.A.

(57) ABSTRACT

A cutting wheels archery broadhead includes a ferrule with an upper fork, a lower fork and a forward tip. An upper sharpened cutter wheel is rotatably mounted in the upper fork. A lower sharpened cutter wheel is rotatably mounted in the lower fork and such wheels overlap within the ferrule. A sharpened arrowhead is mounted in the forward tip portion of the ferrule to assist in broadhead penetration and rotational cutting of the cutter wheels.

31 Claims, 3 Drawing Sheets

CUTTING WHEELS ARCHERY BROADHEAD

BACKGROUND OF THE INVENTION

The present invention relates to an archery broadhead, and more particularly, to an archery broadhead to be mounted on an arrow tip having a substantially greater cutting diameter and blade edge length than other previous prior archery broadheads.

Traditional fixed broadheads generally include a ferrule or body with a chisel like tip. Captured and held within the ferrule are commonly three stainless steel blades. Often the blades are replaceable after they have become dulled or damaged. Such a steel blades can vary in thickness from 0.030 up to 0.080 inches. The cutting edge of an overall single blade typically may be 1 inch to approaching 1.5 inch. This would typically give a fixed broadhead 4.5 inches of cutting edges. A diameter of the fixed broadhead cutting into the prey into which it is shot varies from 1 inch to 1.5 inches. There are also fixed steel blade broadheads that do not have a trocar or chisel tip but rather the blades extend to the actual tip of the broadhead.

Mechanical broadheads are different than fixed broadheads. Mechanical broadheads typically have moveable stainless steel blades. Before launching, the stainless steel blades are collapsed or commonly tucked into the ferrule and held thereat mechanically or suitably with rubber o-rings. Upon impact with the prey, the mechanical steel blades extend outwardly for a much larger cutting diameter which may be as large as 1.5 inches. These mechanical broadheads may have cutting edge lengths on the movable steel blades ranging from 1 inch to approaching 2 inches in length. The overall cutting edge surface of mechanical broadheads typically would not exceed 6 inches. Mechanical broadheads are commonly perceived to have a high failure rate with moveable blade breakage and the possibility of the broadhead ricocheting off the prey at which it is shot.

There is a need for a fixed blade broadhead that has greater cutting edge length and cutting diameter than heretofore known. However, such a desirable broadhead should not be hindered by aerodynamics and therefore should fly true and straight without the possibility of mechanical failure or ricocheting off of the prey at which it is shot.

SUMMARY OF THE INVENTION

A cutting wheels archery broadhead includes a ferrule with an upper fork, a lower fork and a forward tip. An upper sharpened cutter wheel is rotatably mounted in the upper fork. A lower sharpened cutter wheel is rotatably mounted in the lower fork and such wheels overlap within the ferrule. A sharpened arrowhead is mounted in the forward tip portion of the ferrule to assist in broadhead penetration and rotational cutting of the cutter wheels.

A principal object and advantage of the present invention is enlarged cutting diameter greater than any previously known fixed or mechanical broadheads.

Another object and advantage of the present invention is a significant increase in the length of total cutting edges over the previously known broadheads.

Another object and advantage of the present invention is that the cutting wheels perform with a chopping or pushing cut function as opposed to a sliding function of fixed and mechanical blade broadheads which slice through flesh-like material.

Another object and advantage of the present invention is good flight characteristics in that wind does not significantly alter the flight of the broadhead on an attached arrow as the cutting wheels broadhead remains fairly compact.

Another object and advantage of the present invention is that the present invention exhibits good strength and durability with replaceable parts.

Another object and advantage of the present invention is that it does not have a tendency to ricochet off of a prey which it is shot at.

Another object and advantage of the present invention is the myriad of other embodiments pertaining to the cutting wheels which may include spokes, which may be sharpened, which also lightens the weight of the overall broadhead suitably in the range of 75-125 grains.

Another object and advantage of the various embodiments is that the spokes may be sharpened to cut through flesh that moves up against the cutter wheels as the broadhead penetrates into the prey.

Another object and advantage of the other embodiments includes sharp teeth mounted in the plane with the spokes for additional cutting of flesh as the broadhead passes through its prey.

Another advantage of the present invention is that many other embodiments may include a variety of cutting wheel edges from serrations to teeth.

Other objects and advantages will become apparent upon a review of the following specification and drawings.

BRIEF DESCRIPTION OF THE DRAWINGS

1 is a perspective view of the cutting wheels archery broadhead of the present design.

DETAILED SPECIFICATION

Figure 1:
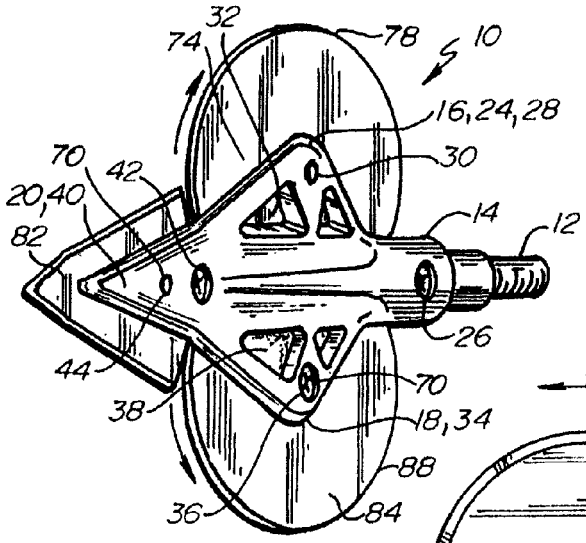

Referring to FIGS. 1 through 6, the cutting wheels archery broadhead 10 of the present invention may be understood.

The present broadhead 10 mounts onto an arrow tip (not shown) by an externally threaded male stud 12. Stud 12 has an aperture 13 (FIG. 6) therethrough for mounting to broadhead 10. Ferrule, core or body 14 is suitably bifurcated, as will be appreciated. Ferrule 14 has an upper arched fork 16 and a lower arched fork 18. A forward tip 20 is at the forward end of ferrule 14 opposite the stud 12. As stated, the ferrule 14 is bifurcated into a left side portion 24 and a mirrored right side portion 48.

Referring specifically to the left side 24 (FIGS. 1, 3 and 7), there is a recessed aperture 26 suitably for mounting stud 12 when actually aligned with aperture 13 of stud 12. Left side has an upper arched fork portion 28 whereat is located a threaded aperture 30. Left upper fork portion 28 suitably has cut outs or reliefs 32. Left side 24 also has a lower arched fork portion 34 with a recessed aperture 36 and wheel alignment pads 38. Left ferrule portion also has a forward tip portion 42 whereat is located recessed aperture 42 and threaded aperture 44.

The mirrored right side ferrule portion 48 (FIG. 2) has a threaded aperture 50 alignable with the stud aperture 13 and left side aperture 26. Similarly, the right side ferrule portion 48 has an upper arched fork portion 52 with a recessed aperture 54 alignable with the threaded aperture 30 on the left side 24. The upper fork portion 52 also has wheel alignment pads 56. Right side 48 similarly includes a lower arched fork portion 58 with a threaded aperture 60 suitably alignable with recessed aperture 36 of the left side 24. At the lower fork portion 58 suitably are cut outs or reliefs 62. Right side 48 also has a forward tip portion 64 with threaded aperture 66 alignable with recessed aperture 42 of the left side 24. Also, the tip portion 64 has recessed aperture 68 also alignable with threaded aperture 44 on the left side forward tip portion 40. Set screws 70 are used in apertures 13, 26, 30, 36, 42, 44, 50, 54, 60, 66 and 68.

Figure 6:
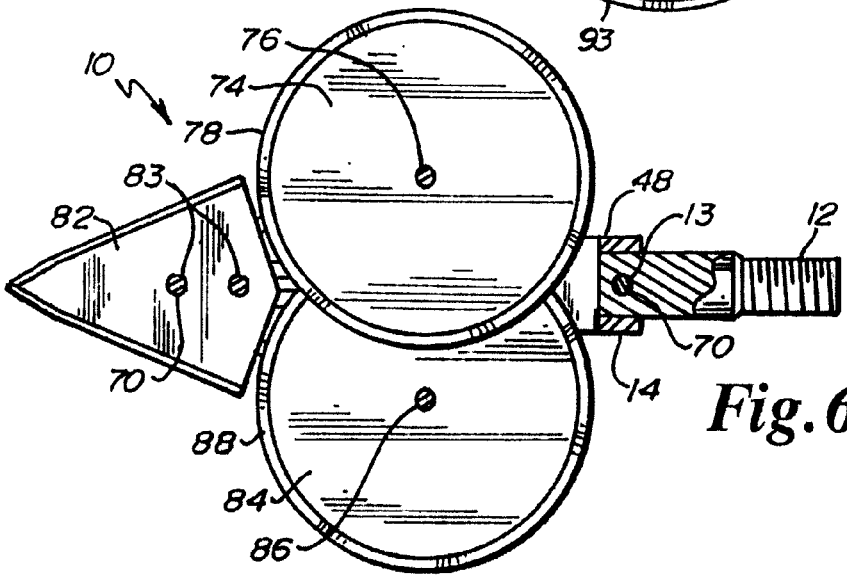
FIG. 6 is a left side elevational view with the left side portion of the bifurcated ferrule removed for ease of understanding assembly and operation.

Archery broadhead 10 has an upper cutting wheel 74 suitably mounted in the upper arched fork 16 by aligning the wheel's center aperture 76 with threaded aperture 30 and recessed aperture 54 whereat a set screw 70 will be secured (FIG. 6). Cutting wheel 74 has a razor sharp edge 78. Cutting wheel 74 suitably has a thickness of 0.013" but may go as thick as 0.40 inches.

The actual diameter of cutting wheel 74 may vary depending on the particular application of archery broadhead 10. Illustratively, cutting wheel 74 may have a diameter of 1⅛ inch (1.125") D. Knowing that the circumference formula is $C=D\pi$, the circumference C of upper cutting wheel 74 when it is of the diameter 1.125" is represented by 1.125"×3.14=3.533" of razor sharp cutting edge 78 along circumference C.

Should a ⅞" (0.875") diameter D be used, the circumference C, given the above formula, would equal 0.875"×3.14=2.748". Almost any desired diameter wheel may be used with this invention.

A planar, triangular, chisel-like arrowhead 82 with apertures 83 is suitably alignable with apertures 42 and 44 and 66 and 68 of the left and right side portions 24 and 48 to be secured thereat with set screws 70. The triangular arrowhead has upper and lower sharpened blade edges B suitably of a length of about 0.900" creating an overall cutting edge of the arrowhead 82 to be 1.8".

Lower cutting wheel 84 is of the same paired dimensions as the particularly used upper cutting wheel 74. Similarly, the lower cutting wheel 84 has a center aperture 86 which is alignable with left side recessed aperture 36 of left side of lower arched fork portion 34 and threaded aperture 60 on the right side lower arched fork portion 58 and is secured thereat with set screw 70.

By way of example, assuming the cutting wheels 74 and 84 have a diameter of 1.125" (D), each wheel has a circumference of 3.533" C whereby the total cutting edges of the combined wheels is 7.07". When smaller diameter wheels 74 and 84 are used suitably such as a diameter of 0.875" D, a circumference of each wheel 74 and or 84 is 2.747" C making a total wheel cutting edge circumference of 5.50".

Figure 3:
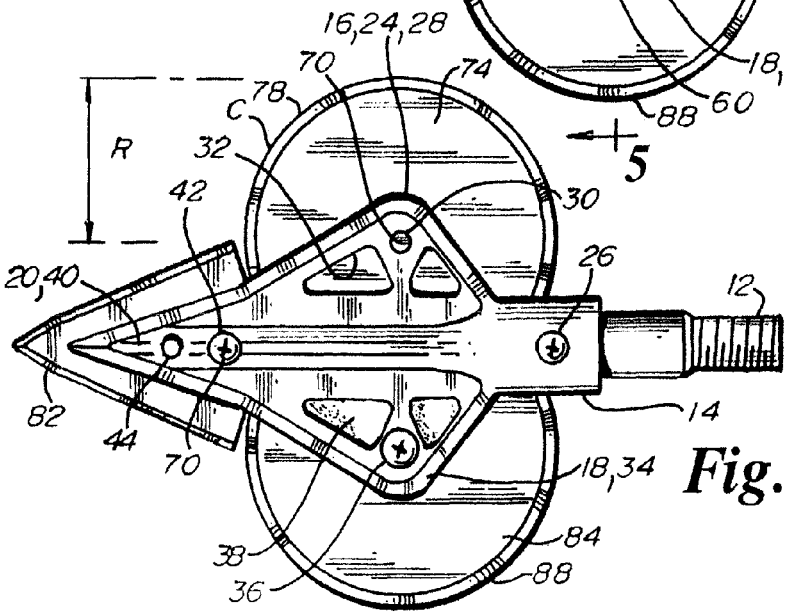
FIG. 3 is a left side elevational view of the present invention.
Figure 7:
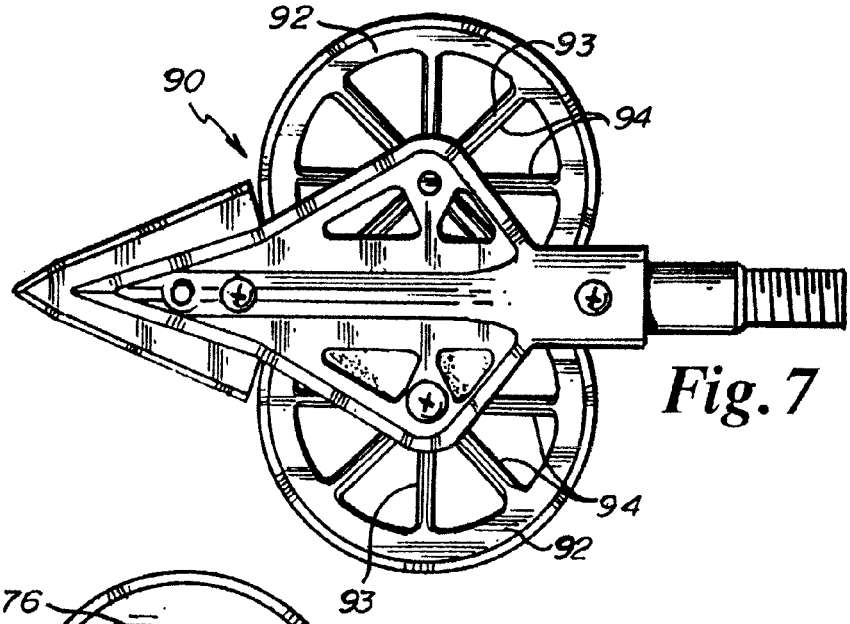
FIG. 7 is a left side elevational view of a second embodiment of the cutting wheels archery broadhead.

Referring to FIGS. 3, 6 and 7, understanding the dimensions of cutting wheels archery broadhead 10 may be appreciated. The broadhead 10 has an overall cutting length O. R and D are the wheels' radius and diameter, respectively. B is the cutting edge of the triangular arrowhead tip 82. L is the distance between axels 76 and 86 of wheels 74 and 84.

Hence, the formula for the cutting diameter of broadhead 10 is (2×R)+L. The broadhead cutting edge overall length is O which equals D+B approximately. The length of wheel cutting edge C is D×7 or 2×R×7. This resultant number is doubled to include both wheels 74 and 84. The total length of cutting edges is (2×B)+(2×C).

The following Chart 1 is a comparative analysis of the dimensions of a typical prior art fixed or mechanical broadhead compared to the present archery broadhead 10 when using 0.875" diameter wheels and when using 1.125" diameter wheels. Of course other diameters or different sized wheels 74 and 84 may be used.

CHART 1

| | DIMENSIONS | | |
|---|---|---|---|
| | Prior Art | .875" Dia. Wheels | 1.125" Dia. Wheels |
| Cutting Diameter | 1.500" | 1.611"<br>2 × .438 R + .735 L | 1.861"<br>2 × .563 R + .735 L |
| Broadhead Cutting Edge Length | 1.500" | 2.025"<br>.900 B + 1.125" O | 1.775"<br>.900 B + .875 O |
| Length of Wheel Cutting Edge | N/A | 2.748"<br>.875 D × 3.14 B | 3.533"<br>1.125 D × 3.14 B |
| Total Length of Cutting Edges | 4.500"<br>(3 × 1.500) | 7.296"<br>2 × .900 B +<br>2 × 2.747 C | 8.866"<br>2 × .900 B of 82 +<br>2 × 3.533 C |

Clearly it may be seen that the cutting diameter of the cutting wheels archery broadhead 10 of the present invention is significantly greater than the prior art. The overall broadhead cutting edge length is similarly substantially greater than the prior art. The length of the wheel cutting edges, which are totally absent from the prior art, are also significant. The total length of cutting edges on the cutting wheels archery broadhead 10 is almost double that of broadheads of the prior art.

Figure 2:
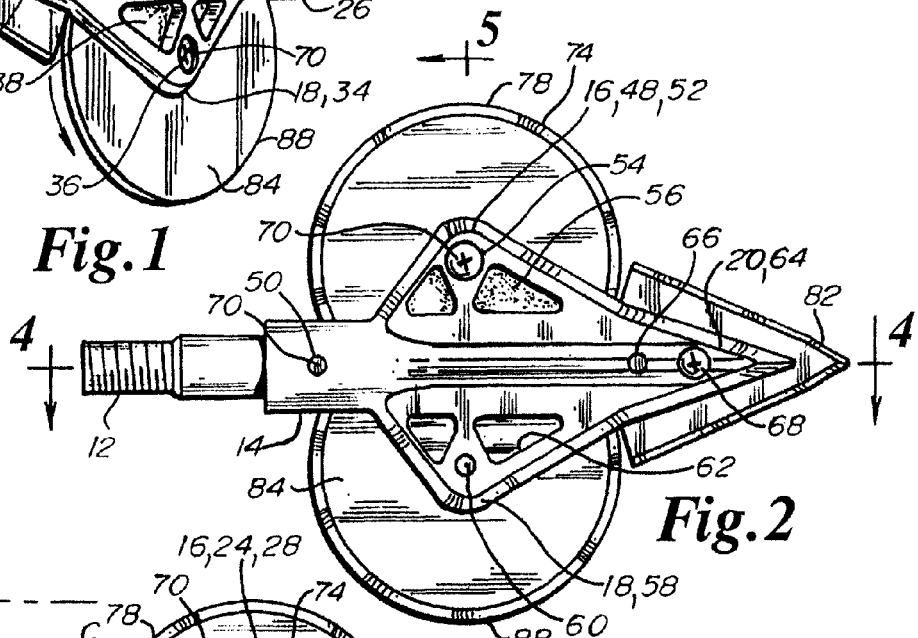
FIG. 2 is a right side elevational view of the present invention.
Figure 5:
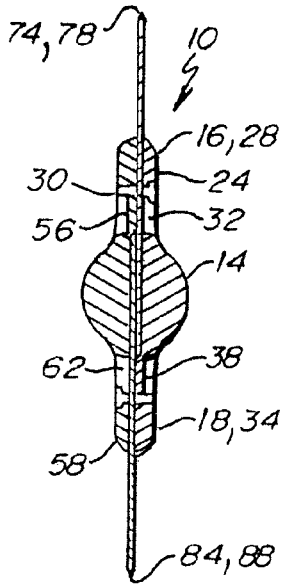
FIG. 5 is a cross sectional view taken along lines 5-5 of FIG. 2.

The wheel alignment pads 38 and 56 showing in FIGS. 1-3 may be further appreciated in FIG. 5. The pads 38 and 56 maintain alignment of wheels 74 and 84 within the bifurcated ferrule 14. By this arrangement, wheels 74 and 84 are not excessively wearing on each other as they rotate through flesh. Pads 38 and 56 also add strength and integrity to the combination of the bifurcated ferrule 14 and cutting wheels 74 and 84.

Referring to FIG. 7, a second embodiment of the cutting wheels archery broadhead 90 may be appreciated. Broadhead 90 has cutting wheels 92 which have been reduced in weight and include spokes 93 to give strength to the wheels 92. If desirable, spokes 93 may have sharp opposing edges 94 suitably for cutting flesh and arteries that may squeeze back upon the broadhead 90 as it passes into its prey.

Figure 8:
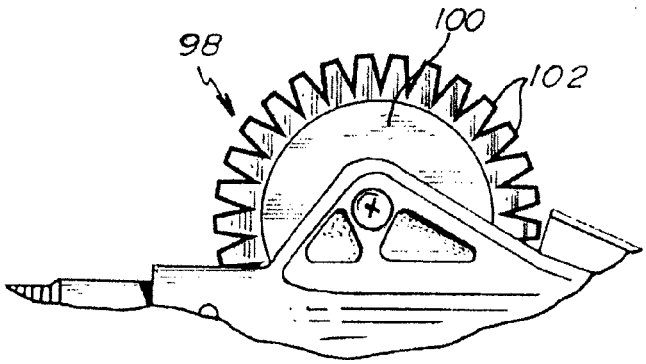
FIG. 8 is a right side elevational view partially broken away of a third embodiment of the cutting wheels archery broadhead.

Referring to FIG. 8, a third embodiment cutting wheels archery broadhead 98 may be appreciated. Broadhead 98 has cutting wheels 100 which have sharp cutting edge teeth serrations 102 which may facilitate a push or chop cutting action.

Figure 9:
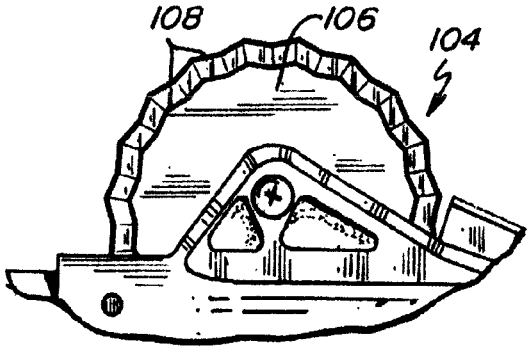
FIG. 9 is a right side elevational view partially broken away of a fourth embodiment of the cutting wheels archery broadhead.

Referring to FIG. 9, a fourth embodiment cutting wheels archery broadhead 104 seen as having cutting wheels 106 with a serrated edge 108 to assist in cutting a chop or push fashion.

Figure 10:
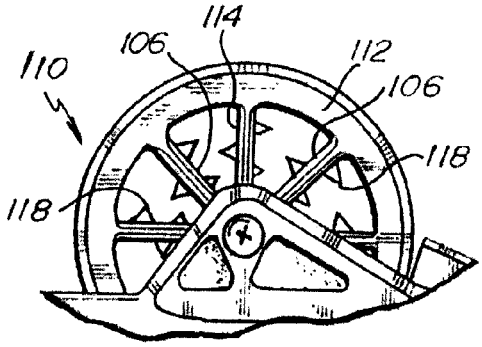
FIG. 10 is a right side elevational view partially broken away of a fifth embodiment of the cutting wheels archery broadhead.
Figure 4:
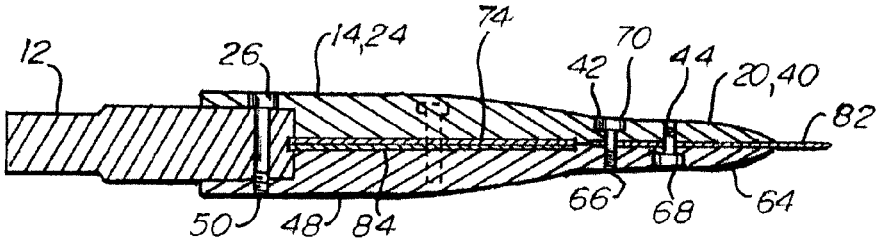
FIG. 4 is a cross sectional view taken along lines 4-4 of FIG. 2.

Referring to FIG. 10, a fifth embodiment cutting wheels archery broadhead 110 which suitably has cutting wheels 112 with spokes 114 with opposing sharp edges 116 and further including sharp opposing teeth 118 which similarly may tear flesh and arteries as it pushes back onto the broadhead 110 as it passes through its prey.

The above specification and embodiments are intended to be for illustrative purposes only and many additional embodiments are possible. The scope of the present invention is intended to be defined by the following claims.

What is claimed is:

1. A cutting wheels archery broadhead, comprising:

a) a ferrule with an upper fork, a lower fork and a forward tip;

b) an upper sharpened cutter wheel rotatably mounted in the upper fork;

c) a lower sharpened cutter wheel rotatably mounted in the lower fork; and d) a sharpened arrowhead mounted in the forward tip to assist in broadhead penetration and rotational cutting of the cutter wheels.

2. The cutting wheels archery broadhead of claim 1, wherein the ferrule is bifurcated into a left side and a right side for sandwiching the cutting wheels and arrowhead.

3. The cutting wheels archery broadhead of claim 2, wherein the left and right sides each have an internal wheel alignment pad to insure proper wheel rotational alignment and to minimize interference between the cutting wheels.

4. The cutting wheels archery broadhead of claim 1, wherein the arrowhead is planar and triangular.

5. The cutting wheels archery broadhead of claim 1, wherein the cutter wheels overlap within the ferrule.

6. The cutting wheels archery broadhead of claim 1, further comprising an externally threaded male stud for mounting the broadhead on an arrow, the stud mounted in the ferrule opposite the forward tip.

7. The cutting wheels archery broadhead of claim 1, wherein the cutter wheels have spokes.

8. The cutting wheels archery broadhead of claim 7, wherein the spokes have sharpened edges.

9. The cutting wheels archery broadhead of claim 7, wherein the spokes have sharpened teeth.

10. The cutting wheels archery broadhead of claim 1, wherein the cutting wheels have serrated sharpened edges.

11. The cutting wheels archery broadhead of claim 1, wherein the cutting wheels have sharpened teeth.

12. A cutting wheels archery broadhead, comprising:

a) a ferrule with an upper fork, a lower fork and a forward tip;

b) an upper sharpened cutter wheel rotatably mounted in the upper fork;

c) a lower sharpened cutter wheel rotatably mounted in the lower fork; and d) a sharpened arrowhead mounted in the forward tip to assist in broadhead penetration and rotational cutting of the cutter wheels and wherein the ferrule is bifurcated into a left side and a right side for sandwiching the cutting wheels and the arrowhead.

13. The cutting wheels archery broadhead of claim 12, wherein the left and right sides each have an internal wheel alignment pad to insure proper wheel rotational alignment and to minimize interference between the cutting wheels.

14. The cutting wheels archery broadhead of claim 12, wherein the arrowhead is planar and triangular.

15. The cutting wheels archery broadhead of claim 12, wherein the cutter wheels overlap within the ferrule.

16. The cutting wheels archery broadhead of claim 12, further comprising an externally threaded male stud for mounting the broadhead on an arrow, the stud mounted in the ferrule opposite the forward tip.

17. The cutting wheels archery broadhead of claim 12, wherein the cutter wheels have spokes.

18. The cutting wheels archery broadhead of claim 17, wherein the spokes have sharpened edges.

19. The cutting wheels archery broadhead of claim 17, wherein the spokes have sharpened teeth.

20. The cutting wheels archery broadhead of claim 12, wherein the cutting wheels have serrated sharpened edges.

21. The cutting wheels archery broadhead of claim 12, wherein the cutting wheels have sharpened teeth.

22. A cutting wheels archery broadhead, comprising:

a) a ferrule with an upper fork, a lower fork and a forward tip and wherein the ferrule is bifurcated into a left side and a right side;

b) an upper sharpened cutter wheel rotatably mounted in the upper fork;

c) a lower sharpened cutter wheel rotatably mounted in the lower fork overlapping the upper cutter wheel; and d) a sharpened arrowhead mounted in the forward tip to assist in broadhead penetration and rotational cutting of the cutter wheels.

23. The cutting wheels archery broadhead of claim 22, wherein the left and right sides each have an internal wheel alignment pad to insure proper wheel rotational alignment and to minimize interference between the cutting wheels.

24. The cutting wheels archery broadhead of claim 22, wherein the arrowhead is planar and triangular.

25. The cutting wheels archery broadhead of claim 22, wherein the cutter wheels overlap within the ferrule.

26. The cutting wheels archery broadhead of claim 22, further comprising an externally threaded male stud for mounting the broadhead on an arrow, the stud mounted in the ferrule opposite the forward tip.

27. The cutting wheels archery broadhead of claim 22, wherein the cutter wheels have spokes.

28. The cutting wheels archery broadhead of claim 27, wherein the spokes have sharpened edges.

29. The cutting wheels archery broadhead of claim 27, wherein the spokes have sharpened teeth.

30. The cutting wheels archery broadhead of claim 22, wherein the cutting wheels have serrated sharpened edges.

31. The cutting wheels archery broadhead of claim 22, wherein the cutting wheels have sharpened teeth.

* * * * *